US006520141B2

(12) United States Patent
Ryczek et al.

(10) Patent No.: US 6,520,141 B2
(45) Date of Patent: Feb. 18, 2003

(54) REWIND COVER GUARD

(75) Inventors: Stephen J. Ryczek, Hartland, WI (US); James D. Makiya, Wauwatosa, WI (US); William M. Kindness, Franklin, WI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 0 days.

(21) Appl. No.: 10/154,226

(22) Filed: May 23, 2002

(65) Prior Publication Data

US 2002/0189571 A1 Dec. 19, 2002

Related U.S. Application Data

(60) Provisional application No. 60/298,221, filed on Jun. 14, 2001.

(51) Int. Cl.[7] ..... F02B 77/00

(52) U.S. Cl. ..... 123/198 E; 123/185.3

(58) Field of Search ..... 123/198 E, 185.3, 123/41.7

(56) References Cited

U.S. PATENT DOCUMENTS

| | | | |
|---|---|---|---|
| 2,741,042 | A | 4/1956 | Brown |
| 3,465,740 | A | 9/1969 | Harkness |
| 3,518,979 | A | 7/1970 | Harkness |
| 3,583,185 | A | 6/1971 | Jacobi |
| 3,744,468 | A | 7/1973 | Braun |
| 3,779,325 | A | 12/1973 | Liuhanen et al. |
| 3,871,350 | A | 3/1975 | Hamman |
| 4,211,058 | A | 7/1980 | Larsen |
| 4,995,356 | A | 2/1991 | Kronich |
| 5,921,214 | A | 7/1999 | Fujita et al. |
| 6,381,881 | B1 | 5/2002 | Heismann |

FOREIGN PATENT DOCUMENTS

| | | |
|---|---|---|
| EP | 1 079 025 | 2/2001 |

*Primary Examiner*—Noah P. Kamen
(74) *Attorney, Agent, or Firm*—Michael Best & Friedrich LLP

(57) ABSTRACT

A rewind cover guard for an internal combustion engine. The guard has a mounting surface and a flange. The mounting surface has an inner edge and an outer edge, and is disposed between the blower housing and the starter rewind cover of the engine. The flange is formed integral with the mounting surface and projects outwardly from the mounting surface near the outer edge. The flange is disposed adjacent the starter rewind cover. The flange extends in a direction transverse to the mounting surface, and is disposed vertically above the rewind cover. The flange has a deflecting surface facing away from the rewind cover, and a lip along the free edge of the flange. The guard diverts water and melted snow away from the rewind cover to help prevent moisture from entering the engine.

8 Claims, 5 Drawing Sheets

REWIND COVER GUARD

This Application claims the benefit of No. 60/298,221, filed Jun. 14, 2001.

BACKGROUND OF THE INVENTION

This application relates to internal combustion engines, and more particularly to a protective covering for a starter rewind of an internal combustion engine.

Internal combustion engines are commonly used to power snow throwers, or other outdoor power equipment. Snow throwers generally operate in an environment with large quantities of snow. The engine powering the snow thrower runs at a relatively high temperature, and snow may melt when contacting the engine. The melted snow may run down the sides of the engine, and flow into the engine housing. Moisture inside the engine housing may cause damage or corrosion, and may harm performance of the engine.

SUMMARY OF THE INVENTION

Engines are made of several components, and the interfaces between the components may provide areas for moisture to enter the engine. The interface between a blower housing and a starter rewind cover is especially susceptible to moisture because the cover projects outward from the engine. An embodiment of the invention preferably reduces the amount of moisture that may enter an engine through the interface between the blower housing and the rewind starter cover.

A guard is placed near the starter rewind cover to divert moisture, such as water or melted snow, away from the cover. The guard has a generally ring shaped mounting surface with an inner edge and an outer edge. A flange formed integral with the mounting surface projects outward from the mounting surface near a portion of the outer edge. The mounting surface is disposed between the blower housing and the starter rewind. In the illustrated embodiment, the rewind cover is disposed on the side of the engine, and the flange extends away from the blower housing above the rewind cover. The guard preferably diverts water or melting snow away from the cover as it runs down the side of the engine. An indentation in the flange may provide clearance for a pull cord and handle that extends away from the rewind cover.

DETAILED DESCRIPTION

Figure 1:
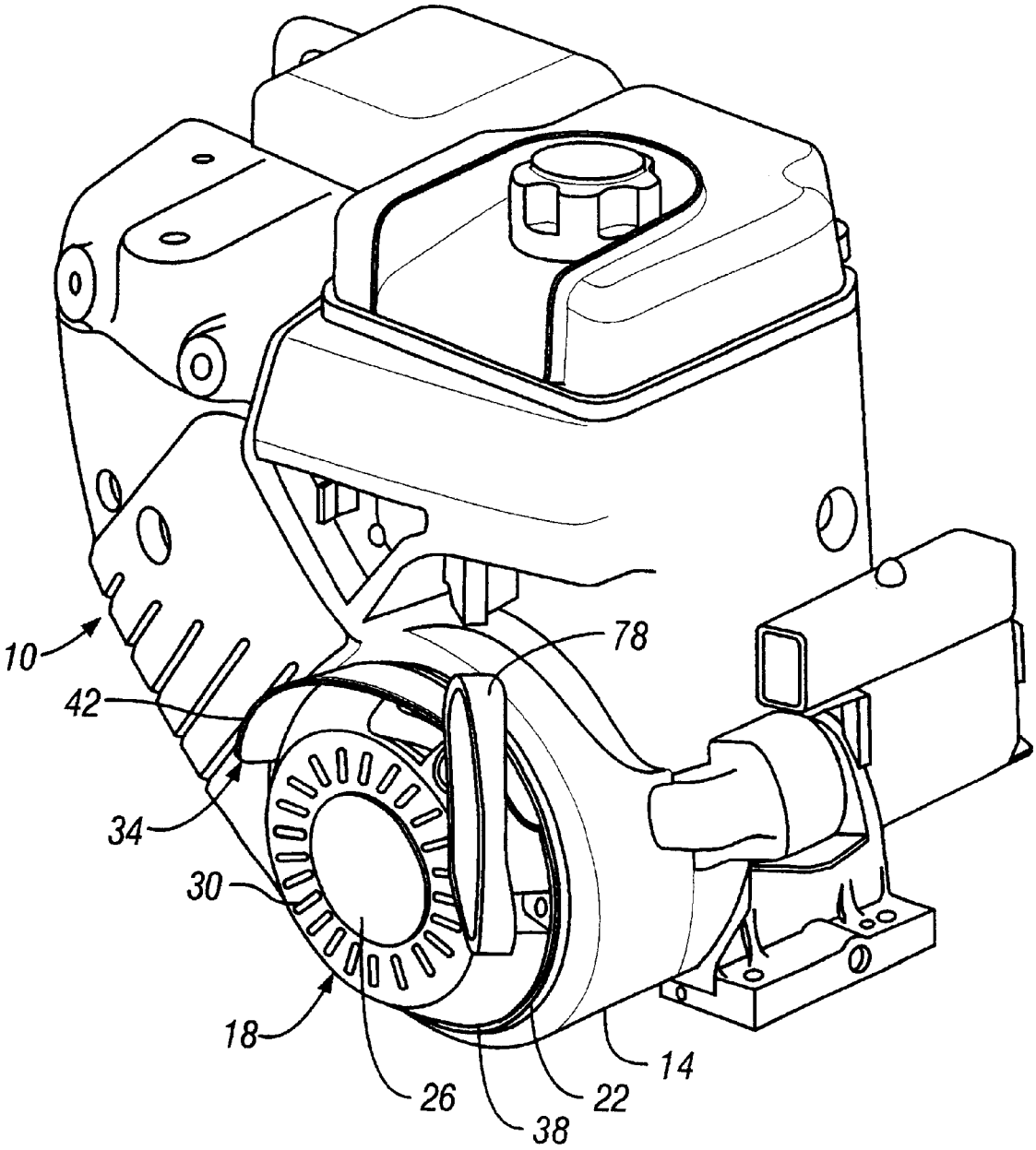
FIG. 1 is a perspective view of an internal combustion engine having a rewind cover guard embodying the invention.
Figure 2:
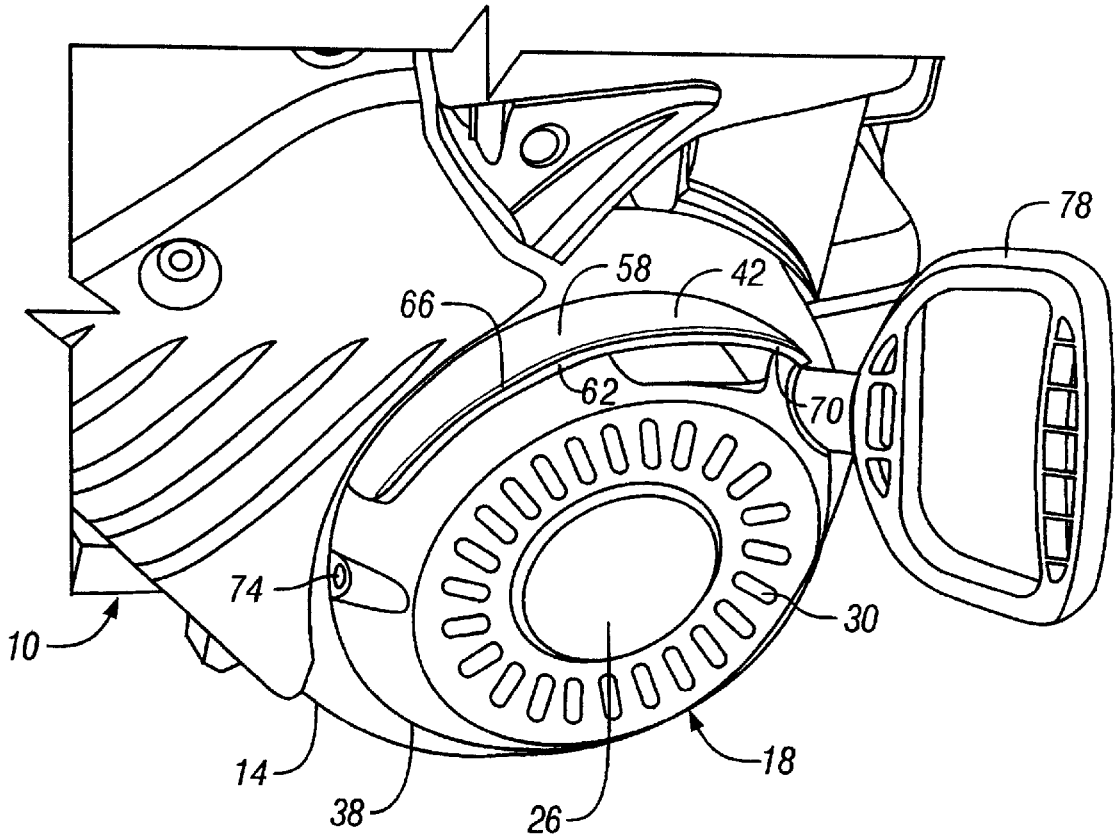
FIG. 2 is an enlarged view of the engine having a rewind cover guard of FIG. 1.
Figure 3:
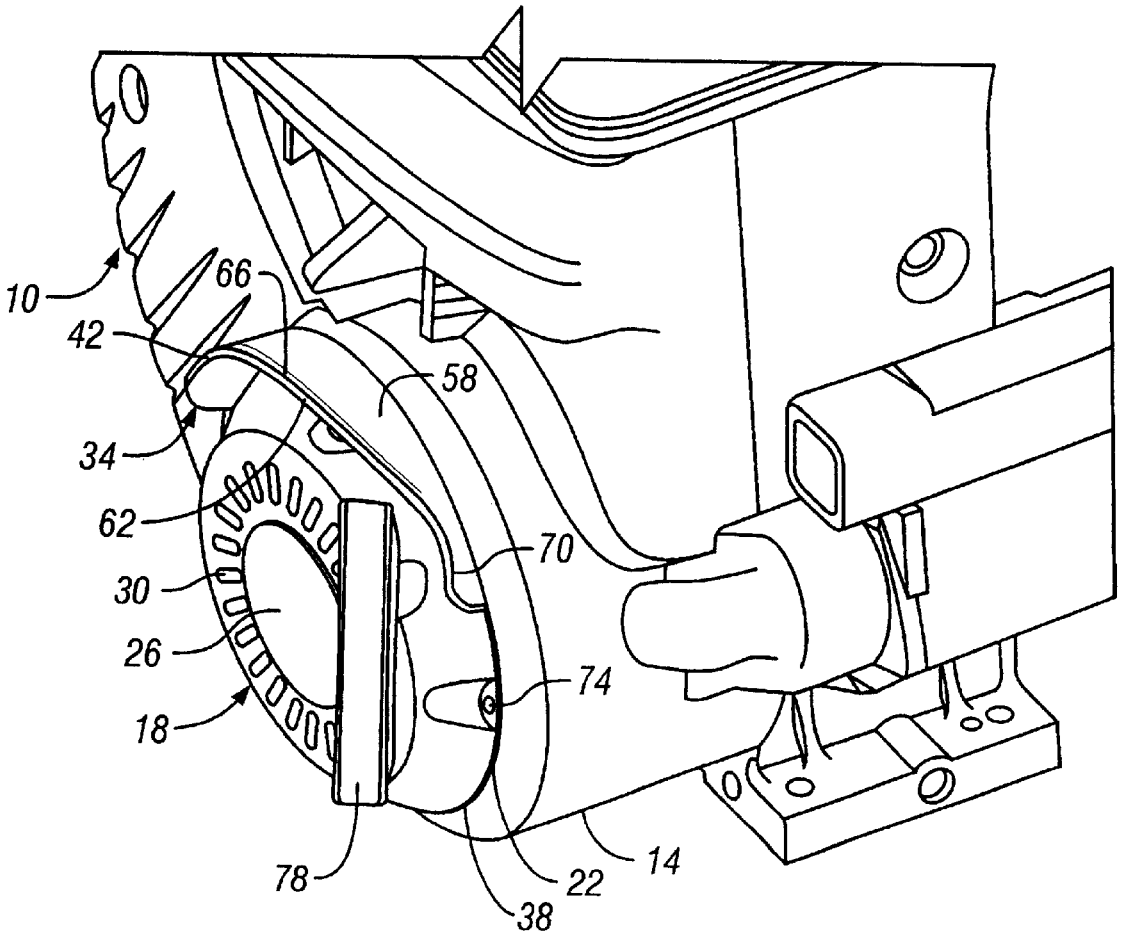
FIG. 3 is an enlarged view of the engine having a rewind cover guard of FIG. 1.

FIGS. 1–4 illustrates an internal combustion engine 10 having a blower housing 14 and a starter rewind cover 18.

The blower housing 14 encloses a fan and the air intake system of the engine 10. The blower housing 14 has an intake opening 22 through which air passes as it enters the blower housing 14. The starter rewind cover 18 is disposed near the intake opening 22 and partially encloses the starter rewind mechanism.

The engine 10 shown in FIGS. 1–4 is a horizontal shaft engine with the starter rewind cover 18 interconnected to the side of the blower housing 14. In the illustrated embodiment, the rewind cover 18 has an outer face 26 that lies in a substantially vertical plane. Air entering the blower housing 14 passes through apertures 30 in the outer face 26. The apertures 30 are sized to permit adequate air flow into the blower housing 14, while helping to prevent relatively large objects or debris from entering the blower housing 14.

Figure 4:
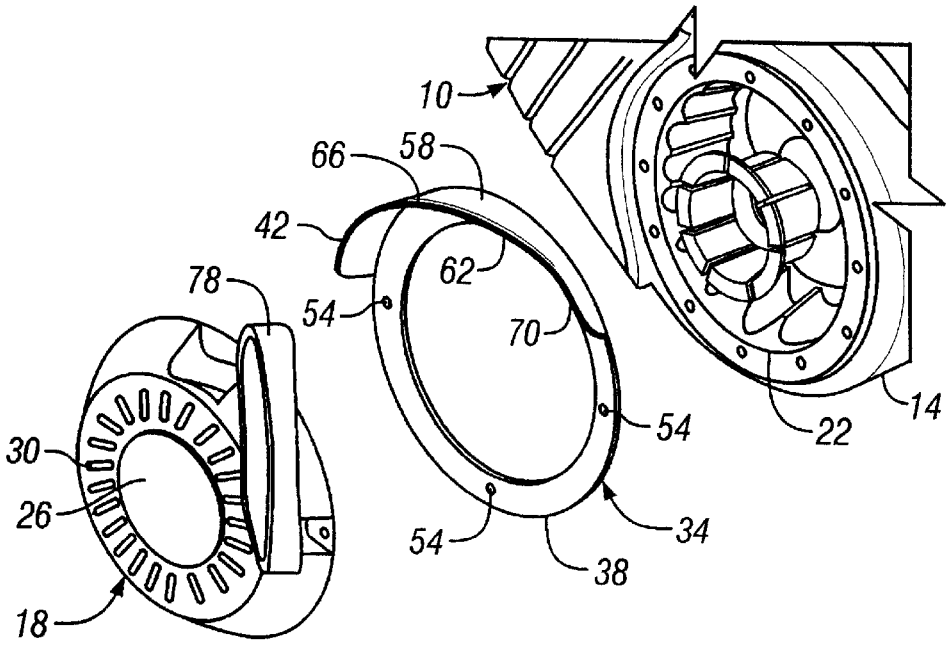
FIG. 4 is an assembly view of the engine having a rewind cover guard of FIG. 1.
Figure 5:
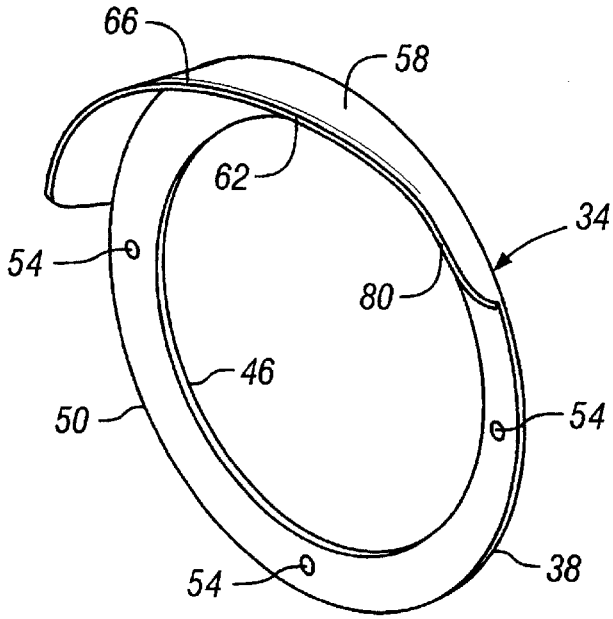
FIG. 5 is a perspective view of the rewind cover guard embodying the invention.

A guard 34 is disposed adjacent the blower housing 14 and rewind starter 18. The guard 34 includes a mounting surface 38 and a flange 42. As shown in FIG. 5, the mounting surface 38 is a generally ring shaped member having an inner edge 46 and an outer edge 50. In the illustrated embodiment, the mounting surface 38 is arc-shaped to correspond to the shape of the intake opening 22 (FIG. 4) of the blower housing 14. However, the mounting surface 38 could also have a multi-sided shape with the inner edge 46 and outer edge 50 comprised of several segments. The mounting surface 38 may have one or more fastening apertures 54 spaced along the mounting surface 38.

The flange 42 is formed integral with the mounting surface 38, and projects outwardly from the mounting surface 38 in a generally axial direction. In the illustrated embodiment, the flange 42 projects in a direction transverse to the mounting surface 38, although it could form various angles with the mounting surface 38. The flange 42 has a deflecting surface 58 on the radially outward face of the flange 42. In the illustrations, the deflecting surface 58 and the flange 42 correspond to the arc-shape of the outer edge 50.

The flange 42 has a free edge 62 at the edge of the flange 42 opposite the mounting surface 38, and a lip 66 that is disposed near the free edge 62. The lip 66 is a slightly raised ridge that projects from the deflecting surface 58 in a direction radially outward from the mounting surface 38. The lip 66 and the deflecting surface 58 channel moisture away from the rewind cover 18 (FIG. 4) and intake opening 22 (FIG. 4). The illustrated embodiment of the flange 42 includes an indentation 70 near an end of the flange 42 where the free edge 62 slants inward toward the mounting surface 38.

Figure 6:
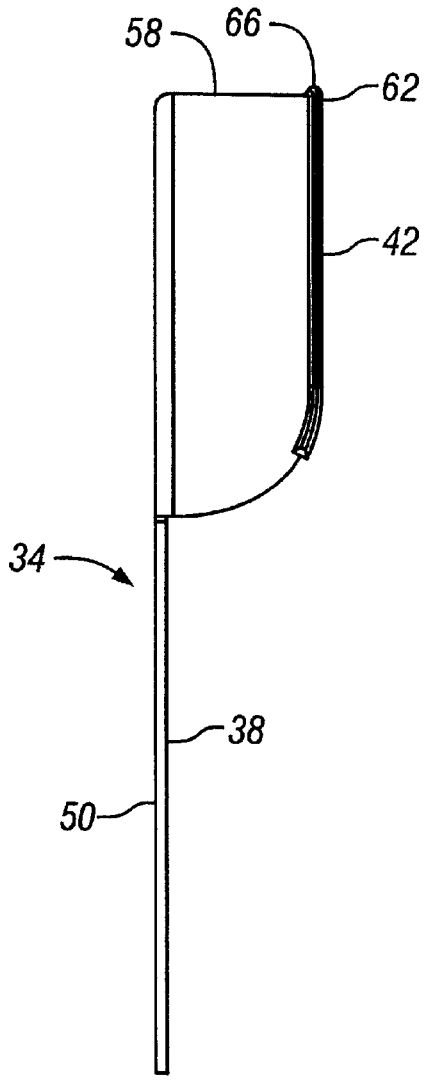
FIG. 6 is a plan view of the rewind cover guard of FIG. 5.
Figure 7:
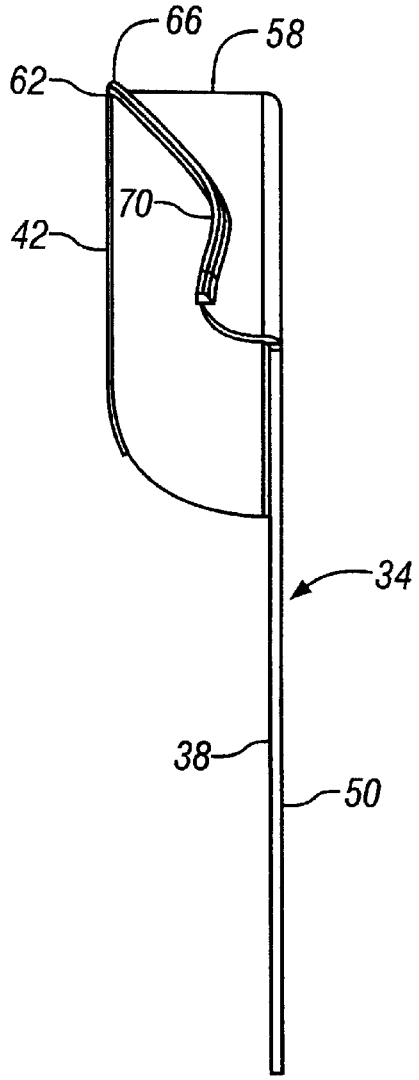
FIG. 7 is a plan view of the rewind cover guard of FIG. 5.

FIGS. 6 and 7 illustrate the flange 42 projecting from the mounting surface 38, as viewed from opposite sides of the guard 34. As shown in FIGS. 6 and 7, the lip 66 projects from the deflecting surface 58 near the free edge 62. As mentioned above, the lip 66 helps direct the flow of moisture across the deflecting surface 58 and away from the rewind cover 18 (FIG. 4) and intake opening 22 (FIG. 4). As shown in FIG. 7, the flange 42 includes an indentation 70 near an end of the flange 42.

As shown in FIGS. 1–4, the guard 34 is disposed near the interface of the blower housing 14 and the rewind cover 18. The rewind cover 18 is coupled to the blower housing 14 with fasteners 74, such as screws, bolts, rivets, or other similar conventional fasteners. The mounting surface 38 is disposed between the blower housing 14 and the rewind cover 18, and the flange 42 extends outward away from the blower housing 14. The rewind cover 18, blower housing 14, and guard 34 are aligned so the fasteners 66 pass through the fastening apertures 54 on the mounting surface 38 before interconnecting to the blower housing 14. The guard 42 is preferably made from a slightly deformable plastic material that may seal the interface between the rewind cover 18 and blower housing 14. The mounting surface 38 may function as a gasket and generally improves the seal between the rewind cover 18 and the blower housing 14.

As mentioned above, this invention may be used on snow thrower engines exposed to environments with large quantities of snow. The running temperature of the engine 10 is above the melting point of snow, so snow that comes in contacts with the engine 10 will melt. Due to gravity, water or melted snow may run down the sides of the engine 10, and the guard 34 diverts the water away from the rewind cover 18. In the illustrated embodiment, the flange 42 extends from at least a portion of the mounting surface 38, and could completely encircle the rewind cover 18. The flange 42 is at least partially disposed above the rewind cover 18, with the deflecting surface 58 facing away from the rewind cover 18. Water running down the engine 10 contacts the curved deflecting surface 58 and is directed around the sides of the rewind cover 18. The lip 66 along the free edge 62 of the flange 42 also diverts the water to the side of the rewind cover, and may prevent water from flowing over the free edge 62 and onto the rewind cover 18.

As shown in FIGS. 1–4, a handle 78 extends away from the rewind cover 18. The handle 78 is attached to a pull cord that is used to start the engine 10 as part of a conventional pull cord starting mechanism. The indentation 70 in the flange 42 provides clearance for the handle 78 during operation of the engine 10, and for the pull cord when the handle 78 is pulled during starting.

While several embodiments of the invention have been shown and described, alternate embodiments will be apparent to those skilled in the art and are within the intended scope of the present invention.

What is claimed is:

1. An internal combustion engine comprising:

a blower housing;

a starter rewind cover adjacent to the blower housing; and a flange disposed vertically above the starter rewind cover that diverts moisture away from the starter rewind cover.

2. The engine of claim 1, wherein the flange extends from the blower housing beyond the starter rewind cover.

3. The engine of claim 1, wherein the flange is substantially arc-shaped.

4. The engine of claim 1, wherein the flange further comprises:

a free edge disposed opposite the blower housing;

a deflecting surface on a face of the flange opposite the starter rewind cover; and a lip disposed along the free edge that is raised from the deflecting surface of the flange.

5. The engine of claim 4, wherein the flange has an indentation in the free edge that provides clearance for a pull cord and handle that extend away from the starter rewind cover.

6. The engine of claim 1, further comprising:

a mounting portion formed integral with the flange, wherein the mounting portion is disposed between the blower housing and the starter rewind cover, and wherein the flange projects outwardly from the mounting portion.

7. The engine of claim 6, wherein the mounting portion is substantially ring shaped and includes an inner edge and an outer edge, and wherein the flange extends from the mounting portion near the outer edge.

8. The engine of claim 1, wherein the flange extends in a direction substantially transverse to the starter rewind cover.

* * * * *